US007281291B1

(12) United States Patent
Hajianpour

(10) Patent No.: US 7,281,291 B1
(45) Date of Patent: Oct. 16, 2007

(54) PAINT ROLLER TOOL FOR CORNERS

(75) Inventor: Zoya Hajianpour, Coral Springs, FL (US)

(73) Assignee: Zoya, Inc., Sunrise, FL (US)

( * ) Notice: Subject to any disclaimer, the term of this patent is extended or adjusted under 35 U.S.C. 154(b) by 128 days.

(21) Appl. No.: 10/746,399

(22) Filed: Dec. 26, 2003

(51) Int. Cl.
*B05C 17/02* (2006.01)

(52) U.S. Cl. ..... 15/230.11; 492/13; 492/19

(58) Field of Classification Search ..... 15/230.11; 492/13, 19
See application file for complete search history.

(56) References Cited

U.S. PATENT DOCUMENTS

| | | | | |
|---|---|---|---|---|
| 3,358,312 | A * | 12/1967 | Parr | 15/230.11 |
| 3,562,837 | A | 2/1971 | Baginski et al. | |
| 3,886,621 | A | 6/1975 | Welsh | |
| 4,402,102 | A | 9/1983 | Al-samman | |
| 5,035,022 | A | 7/1991 | Juliano et al. | |
| 5,386,610 | A | 2/1995 | Batanjski | |
| 5,386,611 | A | 2/1995 | Kim | |
| 5,473,791 | A | 12/1995 | Holcomb et al. | |
| 5,613,264 | A | 3/1997 | Knowles | |
| D405,958 | S | 2/1999 | Moliack | |
| 6,499,177 | B2 | 12/2002 | Napolitan | |
| 6,957,470 | B2 * | 10/2005 | Rivadeneira | 15/230.11 |

FOREIGN PATENT DOCUMENTS

| | | |
|---|---|---|
| DE | 3616114 A1 | 11/1987 |
| GB | 2172820 A | 10/1986 |

* cited by examiner

*Primary Examiner*—Randall Chin
(74) *Attorney, Agent, or Firm*—Ronald V. Davidge

(57) ABSTRACT

A paint roller tool includes first and second paint rollers, mounted to extend from shaft portions of a frame and to turn about axes of rotation perpendicular to one another. Each of the paint rollers includes a peripheral cylindrical surface and a distal end covered with a material suitable for holding and applying wet paint. The paint rollers are separated from one another in a direction perpendicular to both of their axes of rotation and are aligned with one another so that the distal end of each roller is aligned with an outer edge of the cylindrical peripheral surface of the other roller, so that an "L"-shaped area at an interior corner can be painted.

6 Claims, 2 Drawing Sheets

PAINT ROLLER TOOL FOR CORNERS

BACKGROUND OF THE INVENTION

1. Field of the Invention

This invention relates to an appliance for applying paint to walls with a roller, and, more particularly, to such an appliance configured particularly for applying paint to walls in the vicinity of an interior corner.

2. Background of the Invention

A conventional paint roller tool includes a frame, a handle for holding the frame, and a roller rotatably mounted on an end of the frame. The cylindrical periphery of the roller is covered with a surface suitable for holding and releasing paint, but the ends of the roller are not covered with this material. While such a roller is suitable for painting flat wall surfaces it cannot be used to provide effective paint coverage in interior corners, such as the corners of a rectangular room.

U.S. Pat. No. 5,473,791 describes roller and tray apparatus configured particularly for painting interior corners. The apparatus includes a roller assembly having a handle portion, a bearing portion connected to the handle portion, and a replaceable porous roller portion connected to the bearing portion. The roller portion includes a first canted peripheral edge adapted to contact a first interior surface adjacent to an interior corner without contacting a second interior surface adjacent to the interior corner. A tray assembly includes a squeeze area for receiving the roller portion for squeezing out excess coating material from the roller portion. The squeeze area includes a first canted wall portion which is complementary to the first canted peripheral edge and is adapted to squeeze excess coating material out of the roller portion. The roller portion may also include a second canted peripheral edge adapted to contact a second interior surface adjacent to the interior corner without contacting the first interior surface adjacent to the interior corner. The second canted peripheral edge and the first canted peripheral edge are juxtaposed back-to-back to each other, whereby they form an exterior corner that is complementary to the interior corner. The squeeze area of the tray assembly includes a second canted wall portion which is complementary to the second canted peripheral edge and is adapted to squeeze excess coating material out of the roller portion.

UK Patent Application GB 2172820 A describes a paint roller tool having a pair of cone rollers, with their points extending outward, and with the handle of the roller extending from a gap between the rollers. The cone rollers may be made from a plastic material, having outer surfaces covered with lambs wool, mohair, or a synthetic fiber material.

However, what is needed is an apparatus that can be used both for painting a substantial section of a wall adjacent an interior corner, as well as the corner itself.

In order to apply paint to an internal corner as well as to a wall surface, the distal end of a paint roller may be covered with a material for holding and releasing paint. The frame of the paint roller tool then extends only from the proximal end of the roller, which is not covered in this way. For example, as described in U.S. Pat. No. 4,402,102, a corner painting assembly may be attached to the end of a conventional paint roller, with the attachment providing either a bristle end resembling a brush or a flat perpendicular end having a surface identical to the surface of the paint roller. Alternately, a similarly functioning extended paint roller having a bristle end of an end covered with a soft material conducting paint may be used.

U.S. Pat. No. 5,613,264 describes an end cap that can be added to a paint roller, being held in place by inward extending lugs and having formed of a napped material similar to the nap on the surface of the paint roller.

U.S. Pat. No. 6,499,177 describes an end cap assembly for attachment to a commercially available paint roller assembly to allow the application of a coating material, such as paint, uniformly to two intersecting surfaces such as in a corner. The inventive end cap comprises a unitary disc like base having a prong projecting laterally therefrom, the base and prong being formed unitarily from a suitable polymer. A textured material such as fabric, open celled foam, or sheepskin bearing natural wool is adhered to the base. A single prong engages a space existing between the inner surface of the roller cover and the outer surface of the roller frame barrel so that the possibility of damage to the possibly damp paper tube of the roller cover is avoided when the end cap is installed. The prong is straight where joined to the cap at its proximal end, and is curved at its distal or free end. The prong is formed from a material imparting spring qualities.

German Patent Application DE 3616114 A1 describes a cylindrical paint roller composed of a porous material extending around a bearing having a hole extending through the proximal end. A flat end of the porous material may be used to paint a corner.

However, what is needed is a tool for painting both a corner and the wall surfaces adjacent to the corner in a manner that is similarly effective in the application of paint. When a roller having a distal end covered for applying paint is used at a corner, a first strip of one of these adjacent wall surfaces, having a width equal to the length of the roller, is painted, while on the other wall surface a second strip having a width equal to only the diameter of the roller is painted. Each portion of the first strip having a width of the diameter of the roller is exposed to an area of the roller equal to the circumference of the roller times its diameter, or $\pi$ times the square of the diameter of the roller. On the other hand, the second strip, which has a width of the diameter of the roller, is simultaneously exposed to the area of the end of the roller, or to an area equal to $\pi$ multiplied by the square of the diameter of the roller and divided by four. Thus, within the second strip, the area of roller from which paint can be removed is only one quarter the area from which paint is removed for a similar width of wall in the first strip.

The patent literature additionally describes a number of paint roller tools designed for specific applications. For example, U.S. Pat. No. 3,886,621 describes a tool including a paint roller with an elongated cylindrical portion and a hemispherical end, which is used to paint the siding of a building, having overlapping boards. As the cylindrical portion paints one of these boards in a horizontal motion of the tool, the hemispherical portion paints the overlapping bottom edge of the next board up.

U.S. Pat. No. 5,386,611 describes a paint roller tool for painting a post including an external corner, with the tool having a pair of rollers rotating on legs of an L-shaped portion of the frame. A tool with similarly arranged rollers is also shown in U.S. Pat. No. Des. 405,958. Such tools are not suitable for painting the internal corner formed at the intersection of interior walls, since there is a gap between the exterior edges of the rollers, so that the wall surfaces close to the corner cannot be painted.

U.S. Pat. No. 5,035,022 describes a device including a handle assembly having first, second, and third roller mounting assemblies secured thereto for presenting roller applicators in three separate planes, one of which is adjustable relative to the other two. The device is also adapted for disassembly into a device having only one or two rollers. While the device can be used to paint round posts and exterior corners, it does not include rollers having distal ends covered with a material suitable for applying paint to a surface intersecting a wall being painted by the roller peripheral surfaces, and it is not assembled in a configuration suitable for painting walls at an interior corner.

U.S. Pat. No. 5,386,610 describes a paint application device for painting a wall extending to an edge at an internal corner without painting the adjacent wall extending from such a corner. The device includes a handle, a paint application member and a guide member connected to the handle for guiding the paint application member with respect to an inside corner of the surface to be painted. Preferably, the guide member is extendible from the handle for an adjustable distance to adjustably set a desired distance between the inside corner and the paint application member. The guide member extends along an axis parallel to a longitudinal axis of the handle. A wing screw is provided for holding the guide member in a desired extended position. The guide member preferably has at least one roller engageable with the inside corner of the surface to be painted. The guide member is rotatable about an axis perpendicular to the longitudinal axis of the handle. A hinge-tightening handle is provided to prevent rotational movement of the rotatable portion of the guide from a desired angular position. A shield is provided between the handle and the paint application member to protect against paint overspray.

SUMMARY OF THE INVENTION

According to one aspect of the invention, a paint roller tool is provided, including a frame and first and second paint rollers. The frame includes a first shaft portion extending in a first direction and a second shaft portion extending in a second direction, perpendicular to the first direction. The first paint roller, which is rotatably mounted on the first shaft portion, includes a proximal end through which the first shaft portion extends, and a cylindrical peripheral surface and a distal end surface covered with a material suitable for receiving, holding, and applying wet paint. The second paint roller, which is rotatably mounted on the second shaft portion, includes a proximal end through which the second shaft portion extends, and a cylindrical peripheral surface and a distal end surface covered with a material suitable for receiving, holding, and applying wet paint. The second paint roller is spaced apart from the first paint roller in a separation direction, perpendicular to the first and second directions. The distal end of the second paint roller is aligned in the second direction with an outer edge of the cylindrical peripheral surface of the first paint roller. The distal end of the first paint roller is aligned in the first direction with an outer edge of the cylindrical peripheral surface of the second paint roller.

Preferably, the paint roller tool additionally includes a handle attached to the frame, extending away from the paint rollers. The handle may extend in a direction midway between the axes of rotation of the paint rollers form an intersection of a plane extending in the separation direction through the outer edge of the cylindrical peripheral surface of the first paint roller and a plane extending in the separation direction through the outer edge of the cylindrical peripheral surface of the second paint roller. Alternately, the handle may extend in the second direction midway along a length of the first paint roller.

Preferably, the frame includes first and second frame members. The first frame member includes the first shaft portion, while the second frame member includes the second shaft portion. The first and second frame members, which are attached to one another, extend together into the handle.

DETAILED DESCRIPTION OF THE INVENTION

Figure 1:
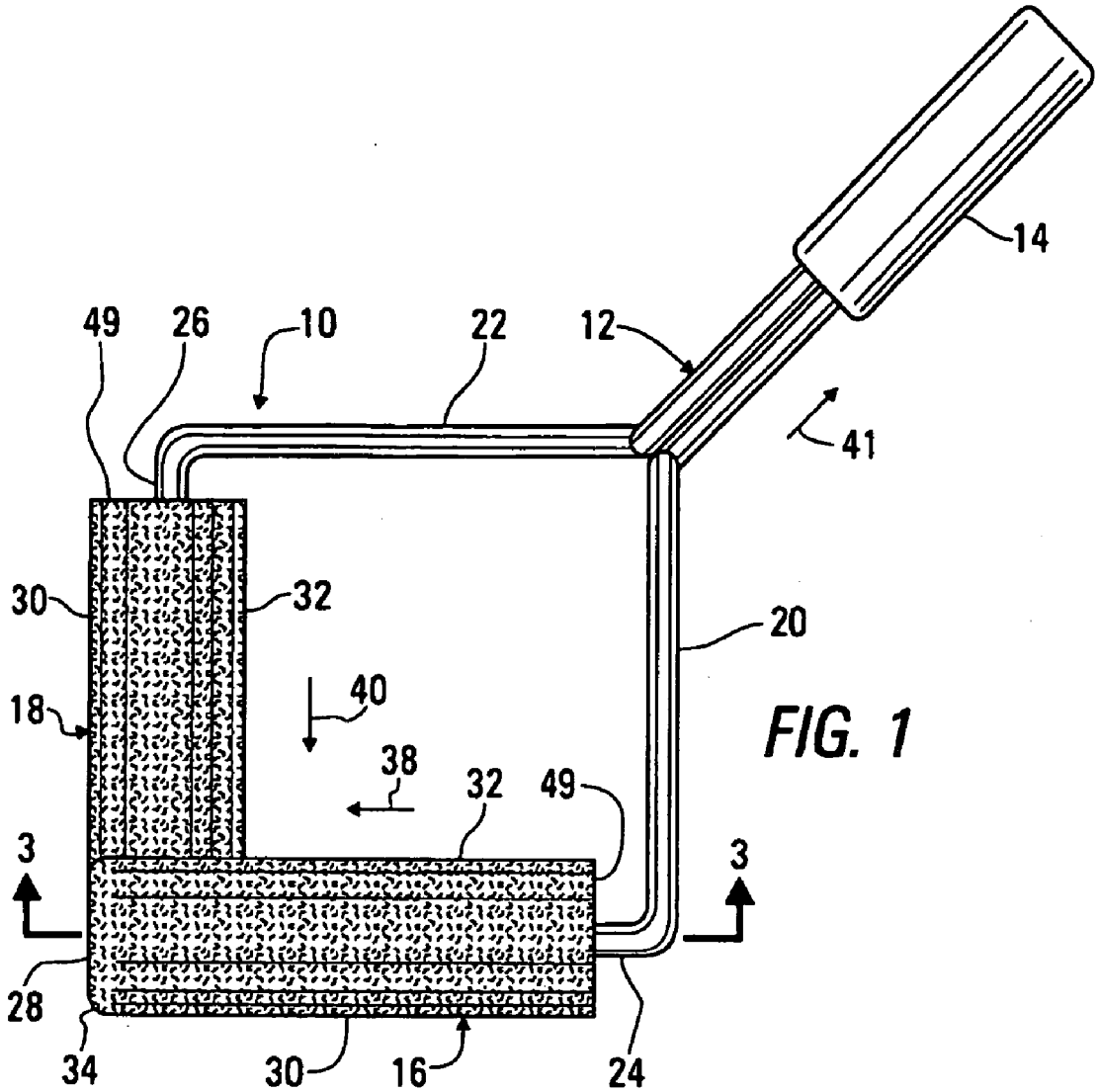
FIG. 1 is a plan view of a paint roller tool built in accordance a first embodiment of the invention.
Figure 2:
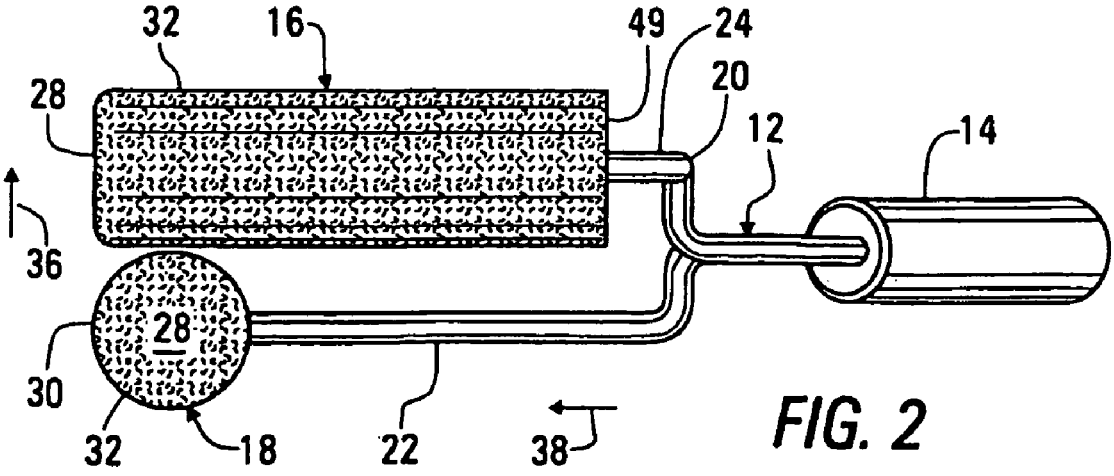
FIG. 2 is a side elevation of the paint roller tool of FIG. 1.

A first embodiment of the invention, in the form of a paint roller 10, will now be discussed in reference to FIGS. 1 and 2. FIG. 1 is a plan view of a paint roller tool 10 built in accordance with a first embodiment of the invention, while FIG. 2 is a side elevation thereof. The paint roller tool 10 includes a frame 12, a handle 14, a first paint roller 16, and a second paint roller 18.

The frame 12 includes a first frame member 20, on which the first paint roller 16 is rotatably mounted, and a second frame member 22, on which the second paint roller 18 is rotatably mounted. The frame members 20, 22 are joined, for example, by welding, and extend together beside one another into the handle 14. The first frame member 20 includes a first shaft portion 24, extending into the first paint roller 16, about which the first paint roller 16 rotates. The second frame member 22 includes a second shaft portion 26, extending into the second paint roller 18, about which the second paint roller 18 rotates. The frame members 20, 22 are configured so that the shaft portions 24, 26 extend in directions perpendicular to one another, so that the paint rollers 16, 18 rotating on these shaft portions 24, 26, are spaced apart from another, and additionally so that the distal end 28 of each of the paint rollers 16, 18 rotating thereon is aligned with the far edge 30 of the other paint roller. This alignment brings the far edges 30 of both of the paint rollers 16, 18 into position to paint an "L"-shaped wall surface, such as the surface formed by an internal corner without leaving an unpainted strip between the painted portions of the wall.

Both the peripheral cylindrical surface 32 of each of the paint rollers 16, 18 and the distal end 28 thereof are covered with a material suitable for picking up wet paint from a tray holding wet paint and for releasing wet paint to a wall surface as the roller 16 is rolled along such a surface. Such materials are well known to those skilled in the art of making paint rollers.

The paint roller tool 10 is thus constructed for use at an interior corner formed by the intersection of two walls, both the peripheral cylindrical surfaces 32 and distal ends 28 of each of the rollers 16, 18 being moved in contact with the walls being painted. While the distal end 28 of each of the rollers 16, 18 may have rounded corners 34, such corners 34 are preferably small enough that compression of the materials forming the rollers during the painting process is sufficient to eliminate a gap between the areas being painted on the intersecting walls.

In accordance with the invention, the frame 12 is configured so that the paint rollers 16, 18 are separated from one another in a direction of separation, indicated by arrow 36, which is perpendicular to both the first direction of arrow 38, in which the shaft portion 24 of the first frame member 20 extends to establish the axis of rotation of the first paint roller 16, and the second direction of arrow 40, in which the second shaft portion 26 of the second frame member 22 extends to establish the axis or rotation of the second paint roller 18. Specifically, the distal end 28 of the first paint roller 16 is aligned with the outer edge 30 of the cylindrical peripheral surface 32 of the second paint roller 18 in the first direction of arrow 38, while the distal end 28 of the second paint roller 18 is aligned with the outer edge 30 of the first paint roller 16 in the second direction of arrow 40.

In accordance with the first embodiment of the invention, the frame 12 is additionally configured so that the handle 14 extends in alignment with the intersection of the planes of the distal ends 28 of the paint rollers 16, 18 and in a direction of arrow 41 that is midway between a direction opposite the direction of arrow 38 and a direction opposite the direction of arrow 40.

Figure 3:
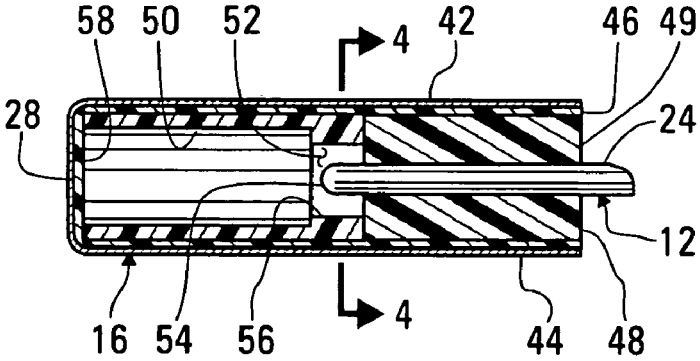
FIG. 3 is a longitudinal cross-sectional view of a paint roller within the tool of FIG. 1, taken as indicated by section line 3-3 therein.
Figure 4:
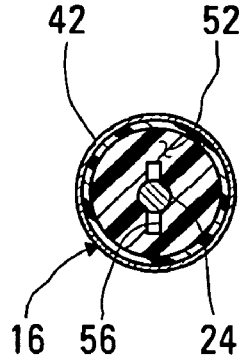
FIG. 4 is a transverse cross-sectional view of the paint roller within the tool of FIG. 1, taken as indicated by section line 4-4 in FIG. 3.

An exemplary construction of the paint rollers 16, 18 will now be discussed, with particular reference being made to FIGS. 3 and 4. FIG. 3 is a longitudinal cross-sectional view of the first paint roller 16, taken as indicated by section line 3-3 in FIG. 1, while FIG. 4 is a transverse cross-sectional view of the first paint roller 16, taken as indicated by section line 4-4 in FIG. 3. The second paint roller 18 is preferably similar in construction to the first paint roller 16.

The paint roller 16 includes a cover 42, having an outer surface 44 suitable for picking up and applying wet paint, extending over a support tube 46 and across the distal end 28 of the paint roller 16. The cover 42 may include, for example, a textile backing material, with an end portion to extend across the distal end 28 being sewn to a sleeve portion extending over the support tube 46. The support tube 46 is attached to a spindle 48 rotatably mounted on the shaft portion 24 of the frame 12. The spindle 48 extends to a proximal end 49 of the paint roller 16, through which the shaft portion 24 extends. The paint roller 16 is additionally attached to the shaft portion 24 by means of an attachment hub 50, along which the support tube 46 is rotatably mounted. A slotted portion 52 of the attachment hub fits over the end 54 of the shaft portion 24, with a slot 56 providing flexibility allowing deflection of the slotted portion 52 to provide forces releasably holding the attachment hub 50 in place on the shaft portion 24. Preferably, the slotted portion 52 extends around the end 54 of the shaft portion 24 to limit the movement of the attachment hub 50 along the shaft portion 24. The attachment hub 50 extends between the spindle 48 and an end plate 58 supporting the cover 42 at the distal end 28 of the roller 16, so that axial movement of the support tube 46 along the shaft portion 24 is limited. Alternately, the end plate 58 may be eliminated, with the attachment hub 50 extending to the distal end of the cover 42.

The outer surface 44 suitable for picking up and applying wet paint may be chosen from a number of materials or surfaces well known to those skilled in the art of designing and making paint rollers. For example, the surface may be a napped material, such as sheepskin, including both the skin and natural wool held by the skin, with the skin serving the purpose of a cloth backing material. Alternately, the outer surface 44 may be formed as a carpet-like nap on a synthetic textile material, such as a polyester or acrylic material. The peripheral cylindrical surface 32 and the distal end 28 may be covered with different types of materials as long as the materials are both suitable for picking up and applying wet paint.

Alternative constructions of a paint roller for use within the invention will now be discussed with reference being made to FIGS. 5 and 6, each of which is a longitudinal cross-sectional view of an alternative paint roller.

Figure 5:
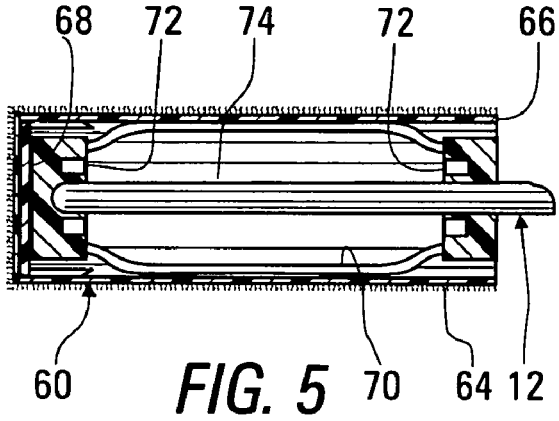
FIG. 5 is a longitudinal cross-sectional view through a paint roller showing a first alternative construction of the paint roller tool of FIG. 1.

Referring to FIG. 5, a first alternative paint roller 60 includes a cover 62 extending over a support tube 66 and an end plate 68, being supported by a number of stringers 70 extending between spindle hubs 72, both of which rotatably attached to an extended shaft portion 74 of the frame 12.

Figure 6:
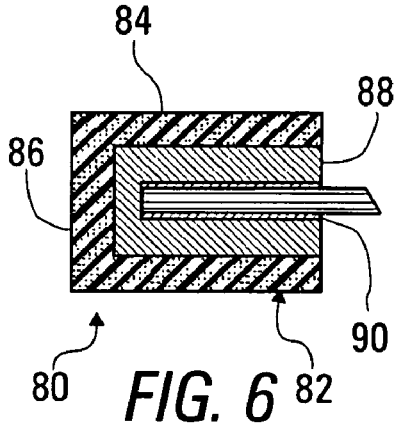
FIG. 6 is a cross-sectional view through a paint roller showing a second alternative construction of the paint roller tool of FIG. 1.

Referring to FIG. 6, a second alternative paint roller 80 includes a cylinder 82 composed of a porous material, such as an open cell thermoplastic foam resin, providing both a peripheral cylindrical surface 84 and a distal end surface 86 suitable for holding and releasing wet paint. The porous cylinder 92 is formed over a core 88 holding a bearing 90, which is rotatably mounted on an extended shaft portion 92 of the frame 12.

The paint rollers 16, 18 are preferably held on the shaft portions 24, 26, while being allowed to rotate thereon, by attachment means well known to those skilled in the art of paint roller design. One such method has been described above in reference to FIGS. 3 and 4. Another method for arranging for the paint rollers 60, 80 to be held in place includes providing a groove within each of the shaft portions 24, 26 of the frame 12, with flexible segments of a hub forming part of each of the rollers 16, 18 extending into the groove to releasably hold the roller in place while allowing its rotation. This last method is described in detail in U.S. Pat. No. 3,886,621, the disclosure of which is incorporated herein by reference.

Figure 7:
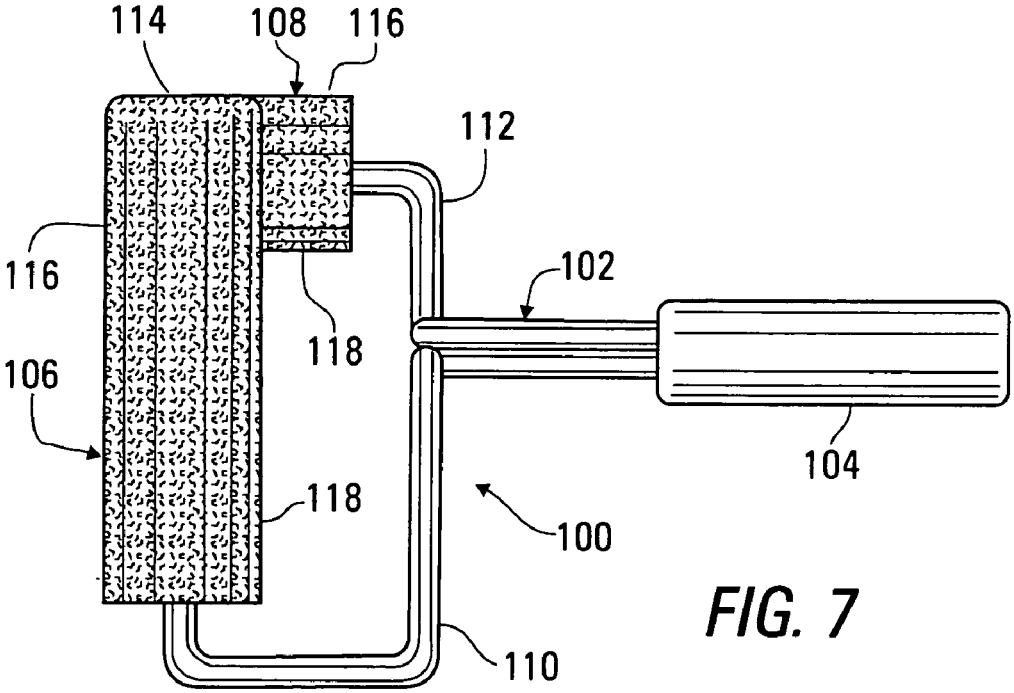
FIG. 7 is a plan view of a paint roller tool built in accordance with an alternative embodiment of the invention.

FIG. 7 is a plan view of an alternative paint roller tool 100, built in accordance with a second embodiment of the invention to include a frame 102, a handle 104, a first paint roller 106, and a second paint roller 108, which may be shorter than the first paint roller 106, as shown, or which may be the same length. This alternative paint roller tool 100 is configured to favor use of the first paint roller 106 to paint a flat wall surface, with the handle 104 extending in a direction perpendicular to the axis of rotation of this roller 106, and with the handle 104 being centrally disposed along the length of this roller 106. Other features of the paint roller tool 10 are retained within the alternative paint roller tool 100, with the frame 102 including an upper frame member 110, on which the upper paint roller 106 is rotatably attached, and a lower frame member 112, on which the lower paint roller 108 is rotatably attached. The frame members 110, 112 are attached to one another to extend together into the handle 104. The frame members 110, 112 are configured so that the distal end 114 of each of the paint rollers 106, 108 is aligned with the outer edge 116 of the other paint roller. Both the peripheral cylindrical surface 118 and the distal end 114 of each of the paint rollers 106, 108 are covered with a material suitable for receiving, holding, and applying fresh paint.

The surface of an entire wall may be painted using the first paint roller 116, with the peripheral surface 118 of the second roller 118 being used to apply paint to the walls intersecting the wall being painted in the corners. The paint roller tool 106 may be inverted to paint the intersecting wall at one of the corners. The painting tool 100 may be held at an angle preventing contact between the distal end 114 of the second roller 108 and the wall being painted as a central portion of the wall, away from the corners, is painted.

Since the paint rolls 16, 18, 106, 108 are separated from one another in either of the paint roller tools, 10, 100, wet paint may be separately applied to each of the two paint rolls of a tool 10, 100, with the tool 10, 100 being inverted between the application of paint to the two rolls.

The use of the present invention, as embodied in either paint roller tool 10, 100, provides a significant advantage over the use of a painting tool, as described in the prior art, having only a single paint roller with a peripheral cylindrical surface and a distal end covered with a material suitable for applying paint. With the prior art painting tool of this kind, a strip of the wall intersecting the wall being painted with the cylindrical periphery of the paint roller is painted with the surface of the distal end of the roller. This strip, which is as wide as the diameter of the paint roller, is painted with a portion of the roller having an area of $\pi$ times one quarter of the square of the diameter of the roller. However, on the wall being painted by the cylindrical periphery of paint roller, each area having a width of the diameter of the paint roller is painted by a part of the roller having an area of $\pi$ times the square of the diameter of the roller. Thus, when this type of prior art painting device is used to paint a corner, the strip being painted on one wall is exposed to only one quarter as much paint roller surface as a similar strip on the other wall.

On the other hand, when a paint roller tool built in accordance with the present invention is used; both walls at a corner are exposed to the paint roller in similar ways, with a strip of the wall equal in width to the diameter of the paint roller being exposed to an area of $\pi$ times the square of the diameter of the roller.

While the invention has been described in its preferred forms or embodiments with some degree of particularity, it is understood that this description has been given only by way of example, and that many variations in the form and combination of parts may be made without departing from the spirit and scope of the invention, as defined in the appended claims

What is claimed is:

1. A frame for a paint roller tool, wherein the frame comprises:

a handle;

a first frame member including a first shaft portion, extending in a first direction to an end of the first shaft portion, and a first handle attachment portion extending within the handle; and a second frame member including a second shaft portion, extending in a second direction, perpendicular to the first direction, to an end of the second shaft portion, and a second handle attachment portion extending into a hole within the handle beside the first handle attachment portion, wherein the second frame member is rigidly attached to the first frame member, wherein the first and second shaft portions are separated from one another through a direction of separation, perpendicular to the first and second directions through a distance sufficient to allow rollers rotating on the first and second shaft portions to extend adjacent one another, with a distal end of a roller rotating on the first shaft portion being aligned in the first direction with an outer edge of a cylindrical peripheral surface of a roller rotating on the second shaft portion.

2. The frame of claim 1, wherein the handle extends away from the first and second shaft portions, in a direction midway between a direction opposite the first direction and a direction opposite the second direction.

3. The frame of claim 1, wherein the handle extends away from the first and second paint rollers in the second direction midway along a length of the first paint roller.

4. A paint roller tool comprising:

a frame including a handle; a first frame member including a first shaft portion, extending in a first direction to an end of the first shaft portion, and a first handle attachment portion extending within the handle; and a second frame member including a second shaft portion, extending in a second direction, perpendicular to the first direction, to an end of the second shaft portion, and a second handle attachment portion extending into a hole within the handle beside the first handle attachment portion, wherein the second frame member is rigidly attached to the first frame member, wherein the first and second shaft portions are separated from one another through a direction of separation, perpendicular to the first and second directions through a distance sufficient to allow rollers rotating on the first and second shaft portions to extend adjacent one another, with a distal end of a roller rotating on the first shaft portion being aligned in the first direction with an outer edge of a cylindrical peripheral surface of a roller rotating on the second shaft portion;

a first paint roller mounted to turn about an axis of rotation on the first shaft portion, including a proximal end through which the first shaft portion extends, a cylindrical peripheral surface with an outer edge, and a distal end surface, wherein the cylindrical peripheral surface and the distal end surface are covered with a material suitable for receiving, holding, and applying wet paint; and a second paint roller mounted to turn about an axis of rotation on the second shaft portion, including a proximal end through which the second shaft portion extends, a cylindrical peripheral surface with an outer edge, and a distal end surface, wherein the cylindrical peripheral surface and the distal end surface are covered with a material suitable for receiving, holding, and applying wet paint, wherein the second paint roller is spaced apart from the first paint roller in a separation direction, perpendicular to the first and second directions, wherein the distal end surface of the second paint roller extends along a plane tangential to the outer edge of the cylindrical peripheral surface of the first paint roller, and wherein the distal end surface of the first paint roller extends along a plane tangential to the outer edge of the cylindrical peripheral surface of the second paint roller.

5. The paint roller tool of claim 4, wherein the handle extends away from the first and second shaft portions, in a direction midway between a direction opposite the first direction and a direction opposite the second direction.

6. The paint roller tool of claim 4, wherein the handle extends away from the first and second paint rollers in the second direction midway along a length of the first paint roller.

* * * * *